US005536339A

United States Patent [19]

Verneker

[11] Patent Number: 5,536,339

[45] Date of Patent: Jul. 16, 1996

[54] AIR BAG INFLATOR GAS COMPOSITIONS AND INFLATOR CONTAINING THE SAME

[75] Inventor: V. R. Pai Verneker, Baltimore, Md.

[73] Assignee: Conducting Materials Corporation, Columbia, Md.

[21] Appl. No.: 312,779

[22] Filed: Sep. 27, 1994

[51] Int. Cl.[6] ..... C06B 47/08

[52] U.S. Cl. ..... 149/19.5; 149/36; 149/77; 149/83; 280/728.1; 280/737

[58] Field of Search ..... 149/19.5, 36, 77, 149/83; 280/228.1

[56] References Cited

U.S. PATENT DOCUMENTS 3,985,375 10/1976 Lewis et al. ..... 280/737

4,203,786 6/1980 Garner ..... 147/19.91

4,414,902 11/1983 Strasser et al. ..... 102/531

*Primary Examiner*—Donald P. Walsh

*Assistant Examiner*—Anthony R. Chi

*Attorney, Agent, or Firm*—Birch, Stewart, Kolasch & Birch

[57] ABSTRACT

Air bag inflators having reduced risk of premature deployment, reduced risk of chemical and thermal burning of the driver, and reduced toxicity are obtained by using a non-sodium azide containing gas generating composition. The gas generating compositions include lithium, potassium and sodium perchlorates, optionally with a nitride or non-halogenated polymer or both, styrene peroxides, polystyrene peroxides, zinc peroxide in hydrated form, iron oxalate hydrazinate, and iron nitrate hydrazinate. A gas generating composition containing copper nitride, sodium perchlorate, and polyester is especially preferred because the resulting gas is compositionally the same as air.

18 Claims, 1 Drawing Sheet

AIR BAG INFLATOR GAS COMPOSITIONS AND INFLATOR CONTAINING THE SAME

BACKGROUND OF THE INVENTION

1. Field of the Invention

This invention relates to compositions that can be used to generate a gas and their use in an air bag inflator.

2. Description of the Prior Art

Conventional automotive air bags inflate quickly after being triggered by a crash sensor, usually located in the front bumper of the automobile. The bag is inflated by the generation of gas from a chemical composition. This composition is usually sodium azide. In a crash, the crash sensors send an electronic signal to a pyrotechnic initiator known as a squib which detonates a first chemical reaction. The flame and heat from this first chemical reaction ignite the sodium azide which in turn produces the inflator gas that blows up the bag.

However, several problems exist in such conventional air bags. Firstly, the chemicals which are contained in the inflator usually include one or more of gun powder, sodium azide, nitroglycerin, boron, potassium nitrate, copper oxide, and hydrochloric acid. Some of these chemicals are poisonous and hazardous. Indeed, the boron present in the inflator, as well as other catalysts, can react with sodium azide to form boron azide. Boron azide is less stable, i.e., more likely to explode, than sodium azide and can thus cause the premature deployment of the air bag. Similarly, the sodium azide can react with metals in contact therewith such as copper-brass to form copper azide. Such metal azides are very explosive and can also lead to the premature deployment of the air bag.

Secondly, the chemical reactions that produce the inflator gas also result in the production of sodium particles and sodium hydroxide particles. These particles, which are produced at a temperature of around 600° C., can pass through the bag and strike the driver, resulting in chemical burns. Further, these particles could cause the bag to burst and thus subject the driver to the hot inflator gas itself.

Finally, the handling and disposal of these air bag inflator compositions is troublesome because many are considered as class A explosives and subject to special federal regulations. Further, the air bag inflator compositions are toxic as are some of the reaction by-products.

Another gas generating composition that has been used in an air bag inflator is a mixture of potassium perchlorate and polyvinylchloride. However, this composition produces toxic chlorine gas upon ignition.

SUMMARY OF THE INVENTION

The present invention relates to strategies for reducing the risk of premature deployment, the risk of burns and or chemical injury, and for reducing the threat of environmental pollution caused by the prior art air bag inflators, especially sodium azide containing inflators.

Accordingly, it is an object of the invention to replace sodium azide with a different gas generating compound and/or composition.

It is another object of the present invention to provide a novel inflator gas composition.

These and other objects can be accomplished by an inflator comprising a housing having at least a first and second interior chamber and an exit port, a pyrotechnic initiator disposed in said first chamber of said housing which generates heat and flame upon activation, and at least one gas generating compound selected from the group consisting of $LiClO_4$, $NaClO_4$, styrene peroxide, polystyrene peroxide, hydrated zinc peroxide, iron oxalate hydrazinate, and iron nitrate hydrazinate, disposed in said second chamber of said housing, wherein said first and second chambers are disposed such that upon activation of said initiator the heat and flame produced thereby causes said gas generating compound to decompose and produce gas which exits said housing through said exit port:

and by an inflator, comprising a housing having at least a first and second interior chamber and an exit port, a pyrotechnic initiator disposed in said first chamber of said housing which generates heat and flame upon activation, and a gas generating composition disposed in said second chamber of said housing and comprising (a) at least one compound selected from the group consisting of $LiClO_4$, $NaClO_4$, and $KClO_4$, and (b) at least one component selected from the group consisting of non-halogenated polymers, nitride compounds, and combinations thereof, wherein said first and second chambers are disposed such that upon activation of said initiator the heat and flame produced thereby causes said gas generating composition to decompose and produce gas which exits said housing through said exit port:

and by an air bag device, comprising an inflatable bag attached to an inflator that contains a gas generating compound and a pyrotechnic initiator such that upon activation by the initiator the gas generating compound decomposes to produce a gas which travels out of the inflator and into the bag, thereby inflating the bag, the improvement which comprises: said gas generating compound is selected from the group consisting of $LiClO_4$, $NaClO_4$, styrene peroxide, polystyrene peroxide, hydrated zinc peroxide, iron oxalate hydrazinate, and iron nitrate hydrazinate:

and by an air bag device, comprising an inflatable bag attached to an inflator that contains a gas generating composition and a pyrotechnic initiator such that upon activation by the initiator the gas generating compound decomposes to produce a gas which travels out of the inflator and into the bag, thereby inflating the bag, the improvement which comprises: said gas generating composition comprising (a) at least one compound selected from the group consisting of $LiClO_4$, $NaClO_4$, and $KClO_4$, and (b) at least one component selected from the group consisting of non-halogenated polymers, nitride compounds, and combinations thereof:

and by a composition which comprises (i) copper nitride or iron nitride, (ii) sodium perchlorate, lithium perchlorate, or potassium perchlorate, and (iii) a non-halogenated polymer.

BRIEF DESCRIPTION OF THE DRAWINGS

Further details are explained below with the help of the example illustrated in the attached drawing, in which.

DETAILED DESCRIPTION OF THE INVENTION

Figure 1:
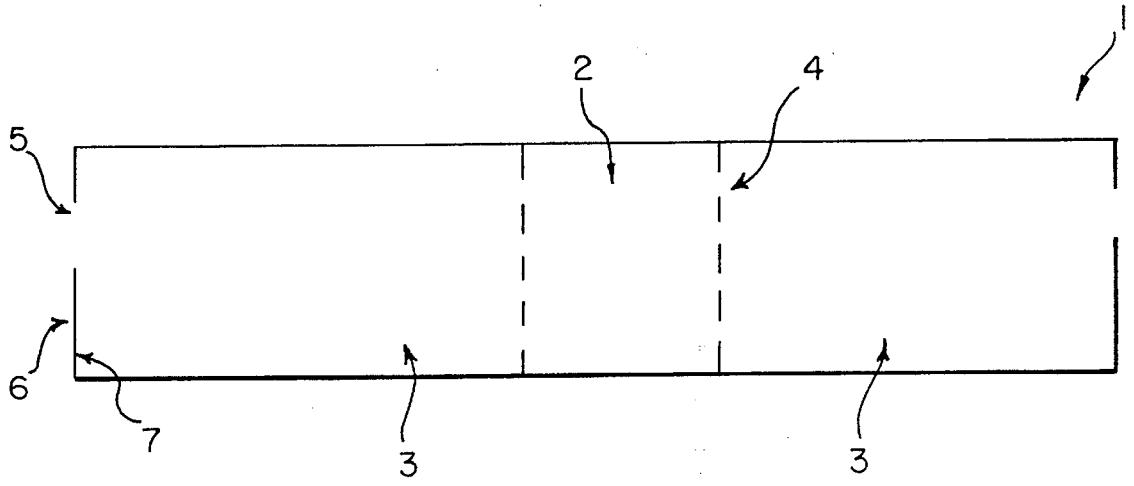
FIG. 1 shows a cross-sectional view of an inflator.

The present invention serves to replace, in whole or in part, the sodium azide containing compositions used in the prior art with less toxic, less hazardous materials. For example, lithium perchlorate ($LiClO_4$), sodium perchlorate ($NaClO_4$), and potassium perchlorate ($KClO_4$) (hereinafter referred to as "the perchlorate compounds") are all non-toxic and are not explosive. However, heating 100 g of $LiClO_4$, $NaClO_4$, or $KClO_4$ to 500° C.–600° C. results in the production 42.3, 36.8, or 32.5 liters of oxygen gas, respectively. Moreover, the residue after such a decomposition is merely LiCl, NaCl, or KCl, respectively. These perchlorate compounds can be used alone or in combination with one another as a replacement for sodium azide.

Further, additional compounds can be used in combination with the perchlorate compounds as gas generating compounds. These compounds include lithium chlorate ($LiClO_3$), sodium chlorate ($NaClO_3$), and potassium chlorate ($ClO_3$). Of course the chlorate compounds, which contain less oxygen, are not as efficient in generating gas as the perchlorate compounds.

If desired, the degradation speed of the perchlorate compound can be increased by incorporating a catalyst such as carbon black, copper chromite, manganese dioxide, metal amines, or transition metal oxides like ferric oxide. Additionally, the decomposition speed can also be increased by other known means such as irradiating the perchlorate with gamma rays or pre-straining the composition.

For example, the perchlorate can be pressed into the shape of a tablet before being used, thereby causing pre-strain (pre-compression). The greater the pressure used in forming the tablet, the greater the speed enhancement effect. The tablet can then be used alone or in combination with other ingredients, including those described below, in the inflator. Alternatively, the tablet can be subsequently powdered and optionally combined with other ingredients without losing the speed enhancement effect.

Additionally, additives that increase the heat of the gas at formation, and thus the thrust of the gas, may be added. These compounds include metals such as aluminum and boron, and metallic hydrides such as lithium aluminum hydride. Such compounds are well known in the rocket engine art. While the gas must be subsequently cooled before it reaches the bag, the higher initial temperature can provide more thrusting power for opening the bag.

The perchlorate compounds can also be combined with a non-halogenated polymer; that is a polymer that does not contain a halogen. These polymers include polystyrenes, polyesters, polybutadienes, polycarbonates, polyacrylates, polyvinyl alcohol, polyvinyl acetate, and polyurethanes, although the later are not preferred because they generate toxic gas. Preferably the polymer is a saturated or unsaturated polyester, especially a polyester represented by the empirical formula $C_8H_{10}O_6$. Examples of suitable polyesters include polyethylene terephthalates. Copolymers and homopolymers are both included within the meaning of the term "non-halogenated polymer." The copolymers can be formed from any combination of monomers such as the monomers used to form the above polymers, so long as no halogen is present.

The non-halogenated polymers typically have a weight average molecular weight in the range of 75,000 to 2,000,000, more preferably 100,000 to 1,000,000. The non-halogenated polymer can be used in a broad range of amounts, but preferably not exceeding a perchlorate:polymer ratio of 30:70. Above this polymer content, the composition may not burn satisfactorily under conventional air bag inflator heat and flame conditions (i.e., 500° C.–600° C.). Preferably the perchlorate:polymer ratio ranges from 90:10 to 40:60.

The perchlorate compound can be combined with the non-halogenated polymer by any suitable means including dry mixing. Such mixing can be carried out in a blender such as a sigma mixer. However, the mixture is preferably formed by mixing the perchlorate compound with a liquid non-halogenated prepolymer and heating until the composition is solidified. The heating temperature is generally around 90° C. to 100° C., depending upon the type of prepolymer being used. As is well understood by workers in the polymer arts, the heating changes the non-halogenated prepolymer into a non-halogenated polymer.

If desired, the degradation speed of the non-halogenated polymer composition can be increased by increasing the porosity of the composition. This can be accomplished by conventional methods as described in *Encyclopedia of Explosives and Related Items* by S. Kaye, U.S. Army, Arradcom, Dover, N.J. 1980, which is herein incorporated by reference. For example, blowing air into the composition during mixing or solidification in order to intentionally trap the air inside the polymer. Alternatively, incorporating hollow spheres into the polymer will also serve to increase the porosity. The spheres are preferably hollow glass spheres with a diameter in the range of 10 to 30 microns.

A non-halogenated polymer is used in the present invention in order to avoid the formation of halogen or halogenated gasses, especially chlorine gas. For example, the use of polyvinyl chloride would result in the production of toxic chlorine gas. Further, by avoiding the use of sodium azide, the residue from the reaction of such a composition is only non-toxic sodium chloride or table salt. Thus, by avoiding the production of such toxic gasses and particulates, the present invention is safer to the driver of the automobile and to the environment.

Moreover, the perchlorate/non-halogenated polymer compositions of the present invention can be made as only class B or C explosives, depending on the weight ratio, instead of the more dangerous class A explosive. Thus, the present invention is less hazardous and easier to handle, transport and dispose of than sodium azide.

The perchlorate compounds can also be combined with a nitride compound. Preferably the nitride compound is copper nitride or iron nitride, most preferably copper nitride. The perchlorate:nitride weight ratio is not particularly limited and can be within the range of 1:99 to 99:1. But based on the relative cost of the compounds and the ratio of $O_2/N_2$ in the gas mixture produced, the ratio range is preferably from 2:98 to 20:80. Indeed, the produced gas can be made to approximate air by using about a 4:96 ratio of perchlorate to nitride.

The perchlorates and nitrides can be mixed by any suitable method including dry mixing in a sigma mixer.

A further embodiment of the present invention combines a perchlorate compound, a nitride compound, and a non-halogenated polymer. The nitride and polymer compounds are the same as those described above. Preferably the nitride compound is copper nitride and the polymer is a polyester represented by the empirical formula $C_8H_{10}O_6$. The nitride:perchlorate:polymer weight ratio is not particularly limited but is preferably 100:1–300:0.01–10, more preferably 100:2–100:0.01–10, even more preferably 100:2–25:0.01–5, and even more preferably 100:2–10:0.01–2. The amount of nitride, perchlorate and polymer are preferably adjusted so that the gas produced is a $N_2/O_2$ mixture that approximates air. Thus a mixture of about 100 parts by weight of nitride, about 3.92 parts by weight of perchlorate compound and about 0.03 parts by weight of non-halogenated polymer is a most preferred ratio of components.

The nitride containing compositions, both with and without the non-halogenated polymer, are non-toxic and non-hazardous. However, such compositions should be kept free from water in a moisture proof container.

Another embodiment of the present invention is to use styrene peroxide or polystyrene peroxide as the gas generating compound. Such a compound would produce carbon dioxide and water upon degradation.

A further embodiment of the present invention is the use of zinc peroxide in hydrated form ($ZnO_2.½ H_2O$) as the gas generating compound. Hydrated zinc peroxide will explode at 212° C. in the presence of zinc metal. The degradation products are zinc oxide (ZnO) and oxygen.

Another embodiment of the present invention is the use of iron oxalate hydrazinate or iron nitrate hydrazinate as the gas generating compound. Upon heating to 300° C. in air, these hydrazinates decompose to produce iron oxide ($Fe_2O_3$), carbon dioxide, nitrogen and water. The iron oxide particles produced is actually magnetic gamma iron oxide. Accordingly, these particles could be trapped by using a magnetic material as at least a part of the housing of the inflator. In this way, the need for filters to screen out particulate matter could be avoided.

All of the above compounds can be made by conventional synthesis techniques known in the chemical arts and most are commercially available. For example a synthesis scheme for making the perchlorate compounds, the styrene peroxide and polystyrene peroxide compounds, and hydrated zinc peroxide compounds is described in *Encyclopedia of Explosives and Related Items*, supra. The synthesis of iron oxalate hydrazinate and iron nitrate hydrazinate can be carried out as shown in U.S. Pat. No. 4,751,070, as well as in V. R. Pai Verneker et al., *Materials Research Bulletin*, vol. 17, pg 29, 1982; V. R. Pai Verneker, *Journal of Material Science Letters*, vol. 2, pg 272, 1983; V. R. Pai Verneker, *Journal of Applied Physics*, vol. 63, pg 272, 1983: all of which are incorporated by reference.

The above described gas generating compounds and compositions can be used in any inflator suitable for decomposing sodium azide into nitrogen gas. By replacing sodium azide with one of the above gas generating compounds, the inflator becomes more reliable regarding premature deployment of the gas, less toxic, and safer to use. Typical inflator structures are shown in U.S. Pat. Nos. 3,958,949, 3,986,456, 3,985,076, and 4,249,673, each of which is incorporated by reference.

FIG. 1 shows a diagrammatical representation of an inflator which can be used in the present invention. A housing 1 comprises a centrally disposed first compartment 2 and a concentric toroidal shaped second compartment 3 disposed around the first. The first compartment 2 contains a pyrotechnic initiator, which is commonly referred to as a squib. Upon receiving an electronic activation signal, the squib detonates a chemical charge, which produces heat and flame. The chemical charge is normally lead styphenate, a very powerful explosive. In a preferred embodiment of the present invention, barium styphenate is used as the explosive in the squib in order to avoid the use of lead and thus be environmentally more acceptable.

The heat and flame extend radially outward from the first compartment 2 into the surrounding second compartment 3 by way of ports 4. The heat and flame ignite the gas generating composition that is contained in the second compartment 3. The generated gas then flows out of the housing 1 by way of the exit ports 5 and into the air bag (not shown).

If iron oxalate hydrazinate or iron nitrate hydrazinate is used as the gas generating compound, then the housing 1 may be made of a magnetic material in order to trap the magnetic particulates (iron oxide) from escaping to the bag. Alternatively, only a portion of the inflator may be magnetic, such as wall 6 or only the inner surface 7 of wall 6, in order to trap the particulates. In either event, such an inflator would be advantageous in that the usual filter system or compartment (not shown) employed in a conventional inflator for removing particulates could be avoided. This would reduce the size of the inflator.

Figure 2:
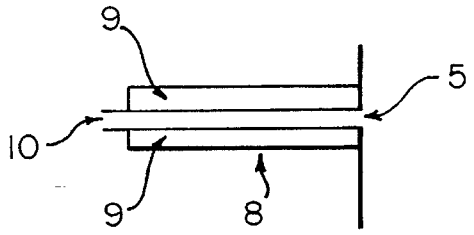
FIG. 2 shows a cross-sectional view of an exit port.

FIG. 2 shows a further embodiment of the present invention, wherein a coaxial tube 8 extends from exit port 5. The outer chamber 9 of the coaxial tube 8 contains a composition having a large latent heat of melting or dehydration such as sodium carbonate.$10H_2$ (hereinafter a "heat absorbing compound"). The gas generated by the gas generating compound/composition will flow through inner chamber 10. As the hot gas travels past chamber 9, the heat absorbing compound will be melted or dehydrated by the heat, thereby removing the heat from the gas. In this way, chamber 9 acts as a heat sink and cools the generated gas. The need for a long pathway to cool the gas may thus be avoided by the present invention.

Further, if iron oxalate hydrazinate or iron nitrate hydrazinate is used as the gas generating compound and wall 6 is magnetic, then the size of the inflator can be significantly reduced owing to the absence of a filter chamber and a shorter required gas flow path.

EXAMPLES 1. 100 grams of a mixture of $NaClO_4$ (70.7 g) and $C_8H_{10}O_6$ unsaturated polyester (29.3 g) is heated at 400° C. to 500° C. The composition will decompose and produce approximately 26.0 liters of carbon dioxide and 1.6 liters of oxygen. The residue will be NaCl.

2. A composition containing 96.2% $Cu_3N$, 3.77% $NaClO_4$, and $C_8H_{10}O_6$ is burned at 500° C. to 600° C. The composition will produce approximately 6.8 liters of air and will leave of residue of approximately 89.6 g of Cu and 1.8 g of NaCl.

The invention having been thus described, it will be obvious that the same may be varied in many ways. Such variations are not to be regarded as a departure from the spirit and scope of the invention, and all such modifications as would be obvious to one skilled in the art are intended to be included within the scope of the following claims.

What I claim:

1. An air bag inflator, comprising:

a housing having at least a first and second interior chamber and an exit port, a pyrotechnic initiator disposed in said first chamber of said housing which generates heat and flame upon activation, at least one gas generating compound selected from the group consisting of $LiClO_4$, $NaClO_4$, styrene peroxide, polystyrene peroxide, hydrated zinc peroxide, iron oxalate hydrazinate, and iron nitrate hydrazinate, disposed in said second chamber of said housing, wherein said first and second chambers are disposed such that upon activation of said initiator the heat and flame produced thereby causes said gas generating compound to decompose and produce gas which exits said housing through said exit port.

2. The inflator according to claim 1, wherein said gas generating compound is $LiClO_4$ or $NaClO_4$.

3. An air bag inflator, comprising:

a housing having at least a first and second interior chamber and an exit port, a pyrotechnic initiator disposed in said first chamber of said housing which generates heat and flame upon activation, a gas generating composition disposed in said second chamber of said housing and comprising (a) at least one compound selected from the group consisting of $LiClO_4$, $NaClO_4$, and $KClO_4$, and (b) at least one component selected from the group consisting of non-halogenated polymers, nitride compounds, and combinations thereof, wherein said first and second chambers are disposed such that upon activation of said initiator the heat and flame produced thereby causes said gas generating composition to decompose and produce gas which exits said housing through said exit port.

4. The inflator according to claim 3, wherein said component (b) is a non-halogenated polymer and said components (a) and (b) are present in a weight ratio ranging from 90:10 to 40:60, respectively.

5. The inflator according to claim 4, wherein said polymer is selected from the group consisting of styrenes, polyesters, polybutadienes, polycarbonates, polyacrylates, polyvinyl alcohol, and polyvinyl acetate, and has a weight average molecular weight in the range of from 100,000 to 1,000,000.

6. The inflator according to claim 3, wherein said component (b) is copper nitride or iron nitride.

7. The inflator according to claim 6, wherein said components (a) and (b) are present in a weight ratio ranging from 2:98 to 20:80, respectively.

8. The inflator according to claim 3, wherein said component (b) is a combination of a non-halogenated polymer and a nitride compound.

9. The inflator according to claim 8, wherein said gas generating composition comprises 78 wt % to 98 wt % of component (a), 1.99 wt % to 20 wt % nitride compound, and 0.01 wt % to 2 wt % non-halogenated polymer.

10. The inflator according to claim 9, wherein said nitride is iron nitride or copper nitride and said non-halogenated polymer is selected from the group consisting of styrenes, polyesters, polybutadienes, polycarbonates, polyacrylates, polyvinyl alcohol, and polyvinyl acetate, and has a weight average molecular weight in the range of from 100,000 to 1,000,000.

11. The inflator according to claim 8, wherein said composition comprises $NaClO_4$, copper nitride, and a polyester represented by the empirical formula $C_8H_{10}O_6$.

12. The inflator according to claim 11, wherein said composition contains about 3.92 parts by weight of $NaClO_4$ and 0.03 parts by weight of polyester per 100 parts by weight of copper nitride.

13. In an air bag device, comprising an inflatable bag attached to an inflator that contains a gas generating compound and a pyrotechnic initiator such that upon activation by the initiator the gas generating compound decomposes to produce a gas which travels out of the inflator and into the bag, thereby inflating the bag, the improvement which comprises: said gas generating compound is selected from the group consisting of $LiClO_4$, $NaClO_4$, styrene peroxide, polystyrene peroxide, hydrated zinc peroxide, iron oxalate hydrazinate, and iron nitrate hydrazinate.

14. A composition which comprises:

(i) copper nitride or iron nitride, (ii) sodium perchlorate, lithium perchlorate, or potassium perchlorate, and (iii) a non-halogenated polymer.

15. The composition according to claim 14, wherein 1–300 parts by weight of the perchlorate compound and 0.01 to 10 parts by weight of the non-halogenated polymer are present per 100 parts by weight of the nitride compound.

16. The composition according to claim 15, wherein said non-halogenated polymer is selected from the group consisting of styrenes, polyesters, polybutadienes, polycarbonates, polyacrylates, polyvinyl alcohol, and polyvinyl acetate, and has a weight average molecular weight in the range of from 100,000 to 1,000,000.

17. The composition according to claim 16, wherein said non-halogenated polymer is a polyester represented by the empirical formula $C_8H_{10}O_6$.

18. The composition according to claim 17, wherein the composition contains about 3.92 parts by weight of sodium perchlorate and 0.03 parts by weight of polyester per 100 parts by weight of copper nitride.

* * * * *